United States Patent [19]

DeWitt et al.

[11] 4,408,743

[45] Oct. 11, 1983

[54] SEAT WITH WEAR-RESISTANT MOUNTING

[75] Inventors: Robert W. DeWitt, Lombard; Lester H. Feddeler, Elk Grove Village, both of Ill.

[73] Assignee: Coach and Car Equipment Corporation, Elk Grove Village, Ill.

[21] Appl. No.: 310,778

[22] Filed: Oct. 13, 1981

[51] Int. Cl.[3] ..... B61L 11/04

[52] U.S. Cl. ..... 248/285; 297/345

[58] Field of Search ..... 248/415, 407, 408, 409, 248/416, 417, 418, 285, 283; 297/345, 349

[56] References Cited

U.S. PATENT DOCUMENTS

| | | | |
|---|---|---|---|
| 1,488,024 | 3/1924 | Nichols | 248/416 X |
| 3,113,804 | 12/1963 | Ritter | 297/349 X |
| 3,642,088 | 2/1972 | Smith | 297/345 X |
| 3,708,203 | 1/1973 | Barecki | 248/416 X |
| 3,885,764 | 5/1975 | Pabreza | 248/415 X |
| 3,960,406 | 6/1976 | Buker . | |
| 3,964,713 | 6/1976 | Joslyn | 297/349 X |
| 4,030,749 | 6/1977 | Strahm | 297/345 |
| 4,134,565 | 1/1979 | Carter | 248/285 |

FOREIGN PATENT DOCUMENTS

| | | | |
|---|---|---|---|
| 972062 | 5/1959 | Fed. Rep. of Germany | 248/408 |

*Primary Examiner*—J. Franklin Foss

*Attorney, Agent, or Firm*—Merriam, Marshall & Bicknell

[57] ABSTRACT

A seat is attached atop a trunnion member rotatably mounted within an intermediate tubular member vertically slidable within a tubular base member. Structure is provided for reducing wear between rubbing surfaces on the trunnion member and the intermediate member, and this same structure functions as part of the elevating mechanism for the intermediate member.

6 Claims, 7 Drawing Figures

SEAT WITH WEAR-RESISTANT MOUNTING

BACKGROUND OF THE INVENTION

The present invention relates generally to seats for crew members of vehicles such as locomotives and more particularly to seats of this type which are vertically adjustable and rotatable.

A conventional crew seat comprises an assembly including a seat cushion attached atop a vertically disposed trunnion member received within a vertically disposed tubular intermediate member in turn supported by a vertically disposed tubular base member which rests on the floor of the vehicle or is cantilevered from a side of the vehicle. Usually, the trunnion member is mounted for rotation about its vertical axis, relative to the tubular intermediate member, and the tubular intermediate member is mounted for vertical adjustment, with the trunnion member, relative to the base member. The seat cushion moves with the trunnion member.

The tubular intermediate member has an upper portion terminating at a top edge defining an open upper end. The trunnion member has a lower portion received within the upper portion of the tubular intermediate member and an upper peripheral lip portion radially overlapping the top edge of the tubular intermediate member. The upper peripheral lip portion of the trunnion member has a lower surface engaging against the top edge of the upper portion of the tubular intermediate member, and when the seat is rotated about the vertical axis of the trunnion member, there is wear between the lower surface on the upper peripheral lip portion of the trunnion member and the top edge on the upper portion of the tubular intermediate member.

It is desirable to be able to lock the seat in one or more predetermined positions of rotation, and this is accomplished by employing a hole extending radially inwardly in the lower portion of the trunnion member. This hole may be rotated into radial alignment with one of a plurality of peripherally or circumferentially spaced holes in the upper portion of the tubular intermediate member, and a pin may be inserted through the radially aligned openings to lock the seat in the position of rotation defined by the aligned openings. The hole in the lower portion of the trunnion member and the circumferentially spaced holes in the upper portion of the tubular intermediate member are located at the same vertical level. However, as a result of the wear described in the preceding paragraph, there can be a drop in the vertical level of the hole in the lower portion of the trunnion member, relative to the vertical level of the holes in the upper portion of the tubular intermediate member. When this occurs, the pin cannot be inserted through both a hole in the upper portion of the tubular intermediate member and the hole in the lower portion of the trunnion member, and the seat cannot be locked in a predetermined position of rotation.

A seat employing conventional mounting structure of the type described above is shown in Buker U.S. Pat. No. 3,960,406.

SUMMARY OF THE INVENTION

A seat assembly constructed in accordance with an embodiment of the present invention includes structure which reduces wear between the top edge at the upper portion of the tubular intermediate member and the lower surface on the upper peripheral lip portion of the trunnion member. In addition, there is structure associated with the tubular intermediate member which provides additional support for the trunnion member, so that the top edge on the upper portion of the tubular intermediate member is not required to provide the entire support for the trunnion member, as in conventional seats. This is accomplished by providing a planar element or plate located within the tubular intermediate member below its open upper end. This planar element has a flat upper surface. The lower portion of the trunnion member has a flat bottom surface located adjacent this planar element.

A friction-resistant, wear-resistant member composed of nylon or high density polyethylene, for example, is sandwiched between the flat bottom surface on the lower portion of the trunnion member and the flat upper surface on the planar element. The trunnion member thus bears against the wear-resistant member sandwiched between it and the planar element, and the planar element comprises structure for supporting the trunnion member.

The load carried by the trunnion member is transferred to the underlying structure at two locations. One is the location where the lower surface of the upper peripheral lip portion of the trunnion member engages against the top edge on the upper portion of the tubular intermediate member. The other location is where the flat bottom surface on the lower portion of the trunnion member engages against the friction resistant, wear-resistant member supported atop the planar element within the intermediate member. The load transfer area between (a) the first bottom surface of the trunnion member and the (b) planar element within the tubular intermediate member is much larger than the load transfer area between (c) the peripheral lip portion of the trunnion member and (d) the top edge of the intermediate member. This substantially reduces the load carried by the top edge of the tubular intermediate member and substantially reduces the forces causing wear at that location. In addition, the interposition of the friction-resistant, wear-resistant member between (a) the bottom of the trunnion member and (b) the planar element within the tubular intermediate member functions to reduce wear at that load carrying location. To the extent that this friction-resistant, wear-resistant member itself undergoes wear, it can be readily and economically replaced.

Another feature of structure constructed in accordance with the present invention is the utilization of the planar element within the intermediate tubular member as part of a spring-actuated elevating mechanism for the seat.

Other features and advantages are inherent in the structure claimed and disclosed or will become apparent to those skilled in the art from the following detailed description in conjunction with the accompanying diagrammatic drawings.

DETAILED DESCRIPTION

Figure 1:
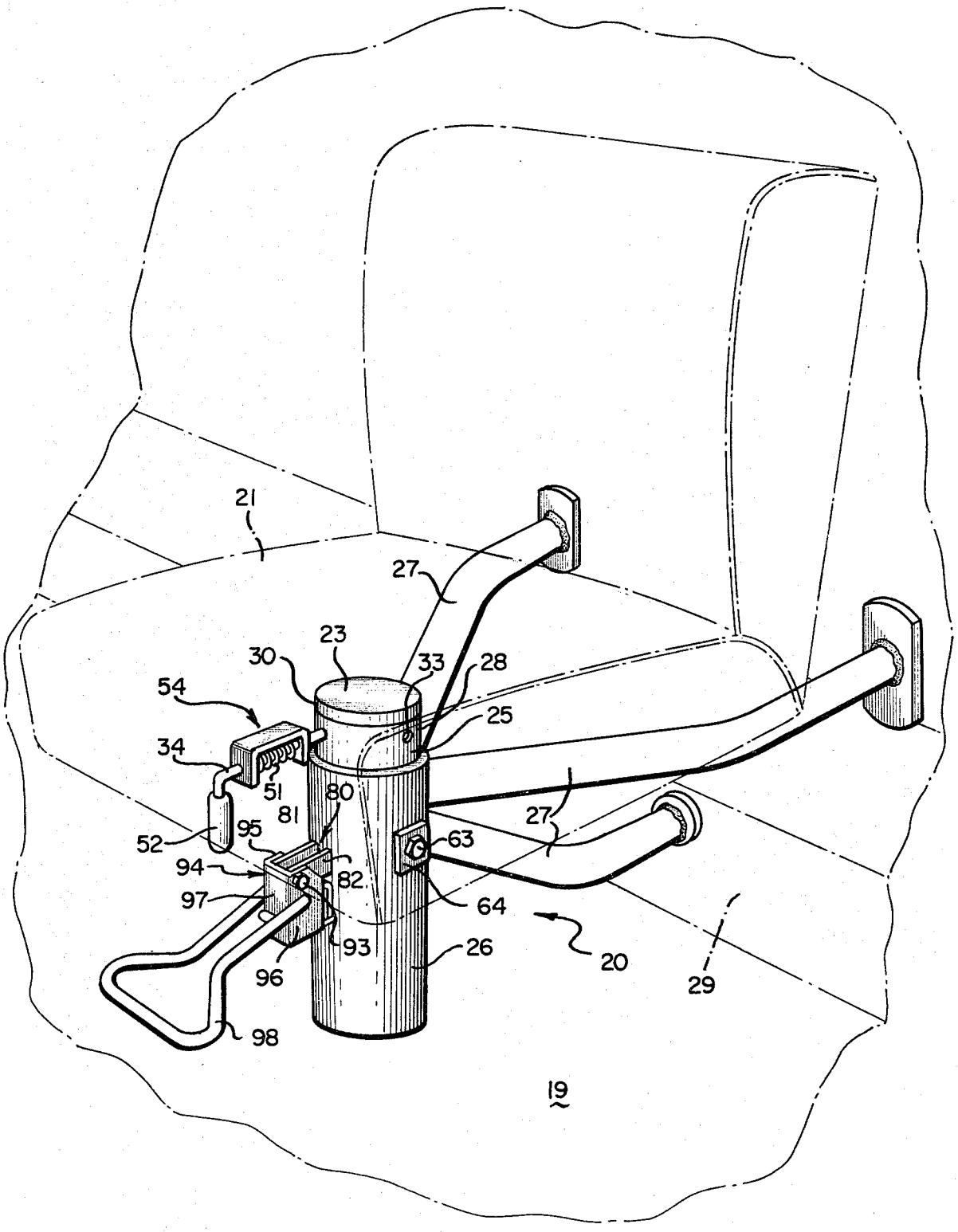
FIG. 1 is a perspective of a seat assembly constructed in accordance with an embodiment of the present invention.

Referring initially to FIGS. 1–5, indicated generally at 20 is a seat assembly constructed in accordance with an embodiment of the present invention. Seat assembly 20 comprises an upholstered seat 21 having a seat pan 22 attached atop a vertically disposed trunnion member 23 having a lower portion 24 fitting inside the upper portion 28 of a tubular intermediate member 25 telescopically mounted within a tubular base member 26 in turn supported by a plurality of frame members 27 extending outwardly from an interior side wall 29 of a vehicle such as a locomotive.

As shown in the drawings, intermediate member 25 and base member 26 are both vertically disposed and vertically aligned. Structure is provided for vertically adjusting intermediate member 25 relative to base member 26, and this structure will be described later.

Figure 5:
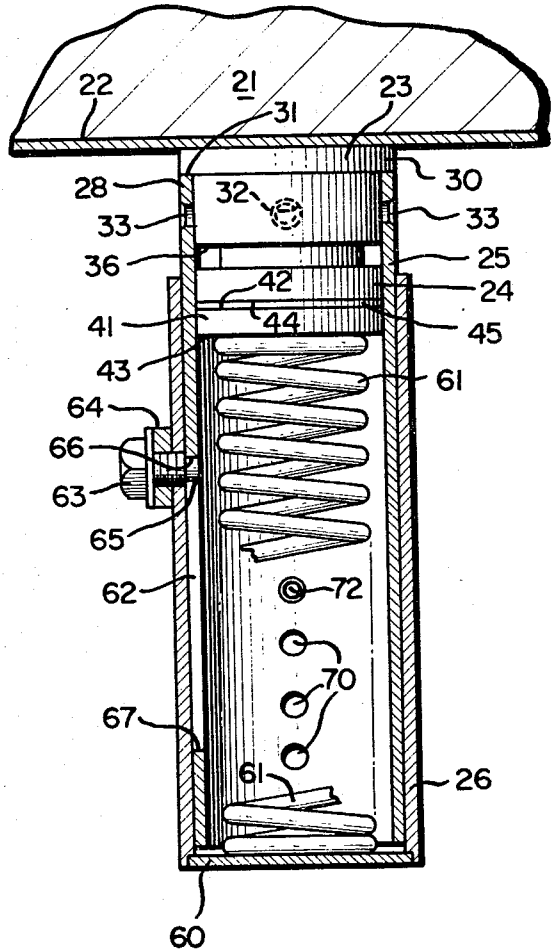
FIG. 5 is a sectional view taken along line 5—5 in FIG. 3.
Figure 4:
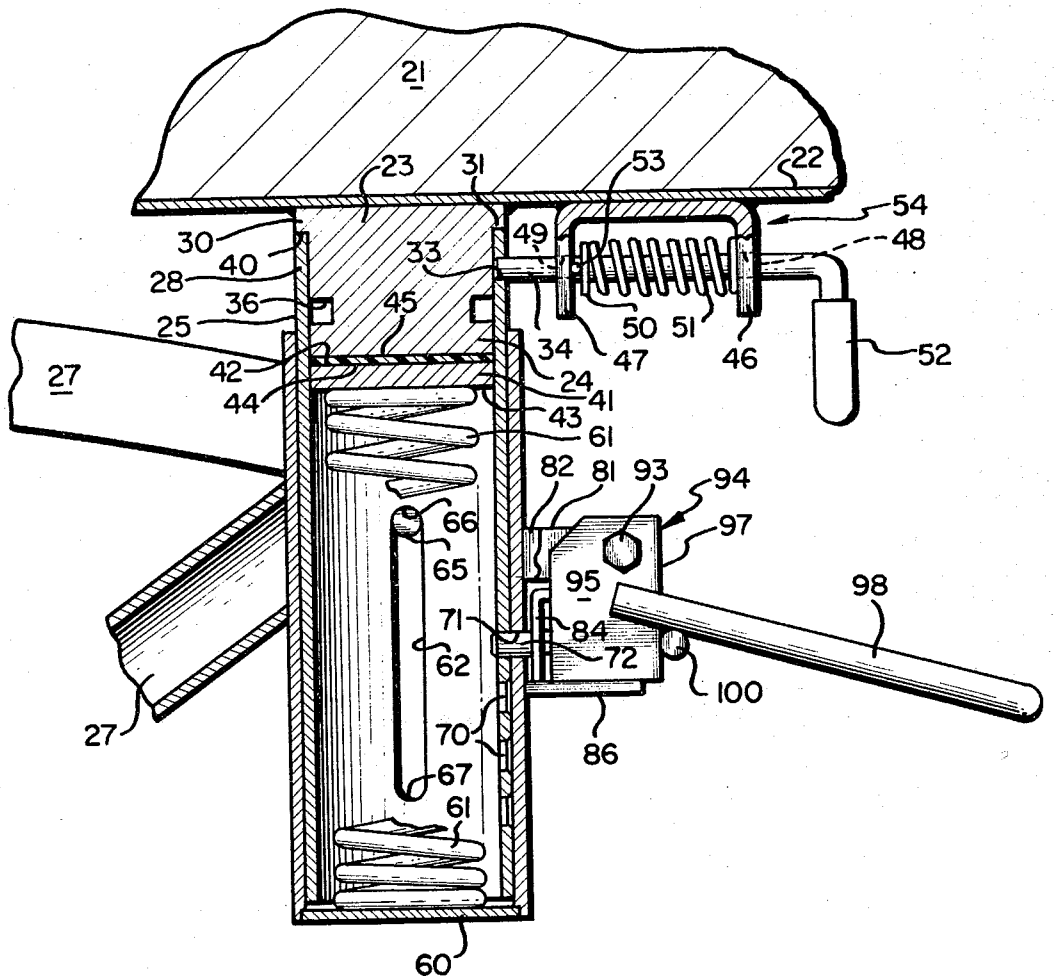
FIG. 4 is a sectional view taken along line 4—4 in FIG. 3.

Both trunnion member 23 and tubular members 25, 26 have cylindrical cross sections. Referring to FIGS. 4–5, intermediate member 25 has an upper portion 28 terminating at a top edge 31 defining an open upper end. Trunnion member 23 has an upper peripheral lip portion 30 radially overlapping top edge 31 on intermediate member 25 and resting thereon. As a result of the manner in which trunnion member 23 is received within and supported by upper portion 28 of intermediate member 25, trunnion member 23 is mounted for rotation about its vertical axis.

Referring to FIGS. 1 and 4–5, extending radially into trunnion member lower portion 24 is a hole 32. Located in upper portion 28 of intermediate member 25 are a plurality of peripherally spaced holes 33, 33. Each of the intermediate member's holes 33 is located at the same vertical level as trunnion hole 32 for axial alignment therewith upon rotation of trunnion member 23 to a predetermined position of rotation. Typically, there are four evenly spaced holes 33, 33 in intermediate member 25 although there can be more or fewer such holes. Each hole 33 corresponds to a predetermined position of rotation, and, when there are four evenly spaced holes, each position is angularly spaced 90° from an adjacent position. The trunnion member may be locked in any one of the predetermined positions of rotation, after hole 32 has been aligned with one of the holes 33, by a pin 34 which is positioned to extend in a radial direction through holes 32, 33 when they are axially aligned. Pin 34 is mounted with its axis at the same vertical level as holes 32, 33 utilizing structure to be described subsequently in detail.

Upper peripheral lip portion 30 on trunnion member 23 has a lower bearing surface 40 engaging against top edge 31 on the upper portion of intermediate member 25. Part of the load represented by seat 21 and its occupant is transferred through the engagement of lower surface 40 of peripheral lip 30 with top edge 31 of intermediate member 25. As trunnion member 23 is rotated with seat 21 among its predetermined positions of rotation, there is rubbing between lower surface 40 on peripheral lip portion 30 and top edge 31 on the upper portion of intermediate member 25. As this rubbing continues, either top edge 31 or lower surface 40, or both, can be worn away, and the net result would be a drop in the level of trunnion member 23 and seat 21 relative to the upper portion of intermediate member 25. When this occurs, there will be a drop in the vertical level of hole 32 in trunnion member 23 relative to holes 33, 33 in the upper portion of intermediate member 25, causing a vertical misalignment of opening 32 relative to holes 33, 33. When this occurs, pin 34 cannot be engaged within both an opening 33 and opening 32, thereby preventing the locking of trunnion member 23 in one of its predetermined positions of rotation.

In accordance with the present invention, structure is provided to overcome the problem described in the preceding paragraph.

Fixed within intermediate member 25, below its upper end, is a planar element or a plate 41 having a flat upper surface 42 and a lower surface 43. The trunnion member's lower portion 24 has a flat bottom surface 44 located adjacent plate 41. There is a friction resistant, wear resistant member 45 sandwiched between flat bottom surface 44 on the lower portion of the trunnion member and flat upper surface 42 on plate 41.

Plate 41 comprises structure for supporting trunnion member 23. Much of the load carried by trunnion member 23 is transferred to plate 41 at the area where flat bottom surface 44 contacts wear resistant member 45 atop flat upper surface 42 on plate 41. Because the area of contact at the location of plate 41 is much greater (69% larger) than the area of contact between lower surface 40 on lip portion 30 and top edge 31 on intermediate member 25, much more of the load carried by trunnion member 23 is transferred to the underlying structure at plate 41 than at top edge 31 of intermediate member 25. In addition, because the engagement of flat bottom surface 44 on the trunnion member with flat upper surface 42 on the plate is through the medium of friction-resistant, wear-resistant member 45, there is little or no wear on surfaces 44 and 42.

As a result of the structural relationships described in the preceding paragraphs, there is also very little, if any, wear between top edge 31 on intermediate member 25 and lower surface 40 on the trunnion member's lip portion 30. Because wear between lower surface 40 on lip portion 30 and top edge 31 on intermediate member 25 is essentially eliminated, radially extending hole 32 in the lower portion of trunnion member 23 is maintained at the same vertical level as the angularly spaced holes 33, 33 in upper portion 28 of intermediate member 25.

Member 45 is flat and disc-shaped and has high wear resistance together with a relatively low coefficient of friction. Typically, member 45 may be composed of nylon or high density polyethylene, although other suitable materials having a high resistance to abrasive wear would be suitable. Such other materials may include bronze bearing material or Delrin acetyl resin. Delrin is a trademark of DuPont Co., Wilmington, Del., and it is a thermal plastic polymer manufactured by the polymerization of formaldehyde.

Figure 2:
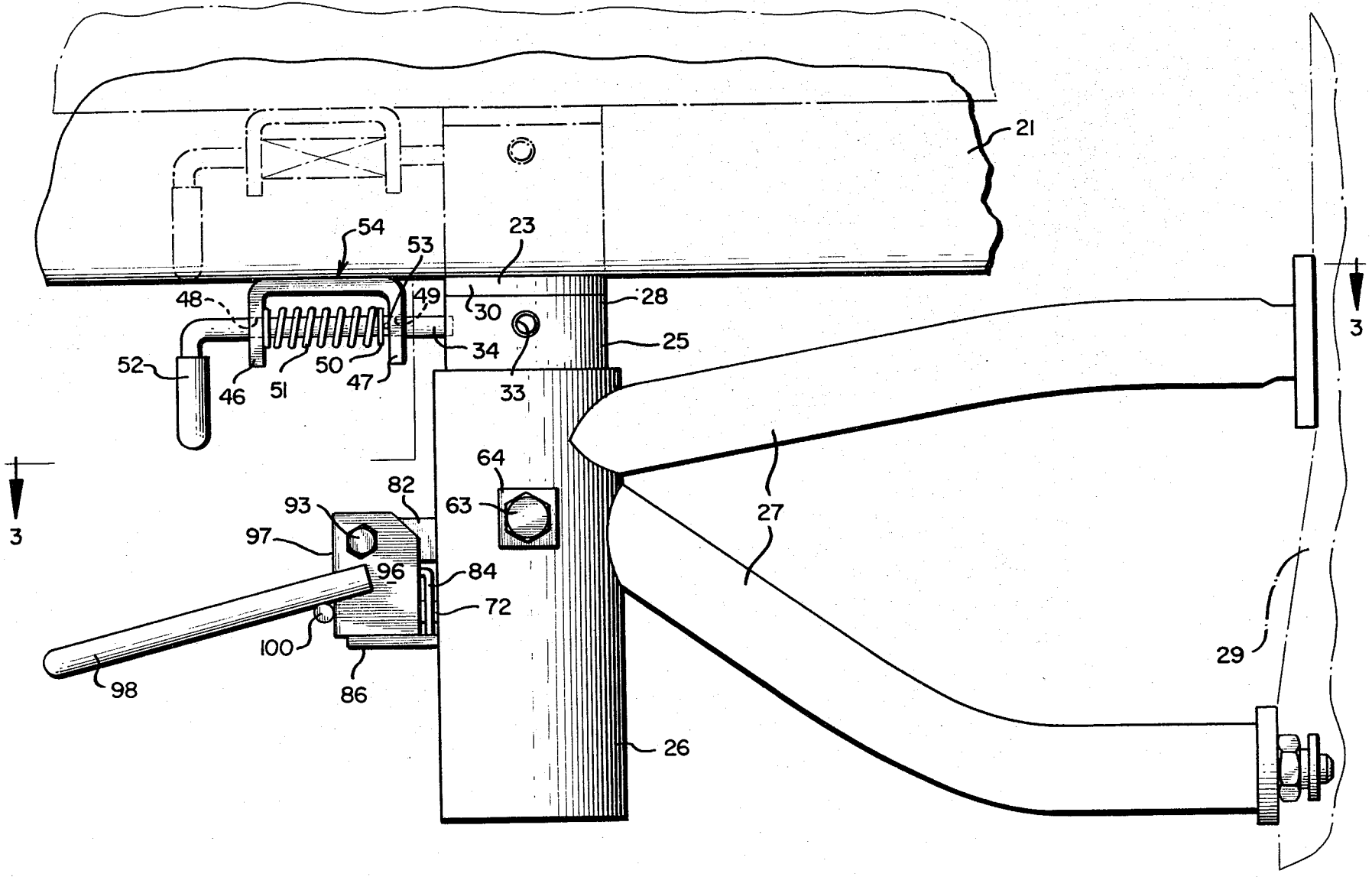
FIG. 2 is a side elevational view of mounting structure for the seat.

Structure for mounting lock pin 34 will now be described, with reference to FIGS. 1, 2 and 4. Depending from seat pan 22 is a U-shaped bracket 54 having a pair of downwardly depending arms 46, 47, each having a respective opening 48, 49 through which extends pin 34 to mount the pin for axial movement in a radial direction toward and away from intermediate member 25. Attached to that part of pin 34 located between bracket arms 46, 47 is a collar 50, and mounted around that portion of pin 34 between arms 46, 47 is a coil spring 51 having one end bearing against collar 50 and another end bearing against bracket arm 46. Extending transversely through pin 34, between collar 50 and arm 47 is a cross pin 53.

Coil spring 51 normally urges pin 34 in a radially inward direction, relative to intermediate member 25. Radially inward movement of pin 34 is limited by the engagement of cross pin 53 with the inner surface of arm 47.

Pin 34 may be retracted radially outwardly, against the urging of spring 51, by pulling on pin handle portion 52 integral with pin 34. Radially outward movement of pin 34 is limited by the compression of coil spring 51.

Figure 7:
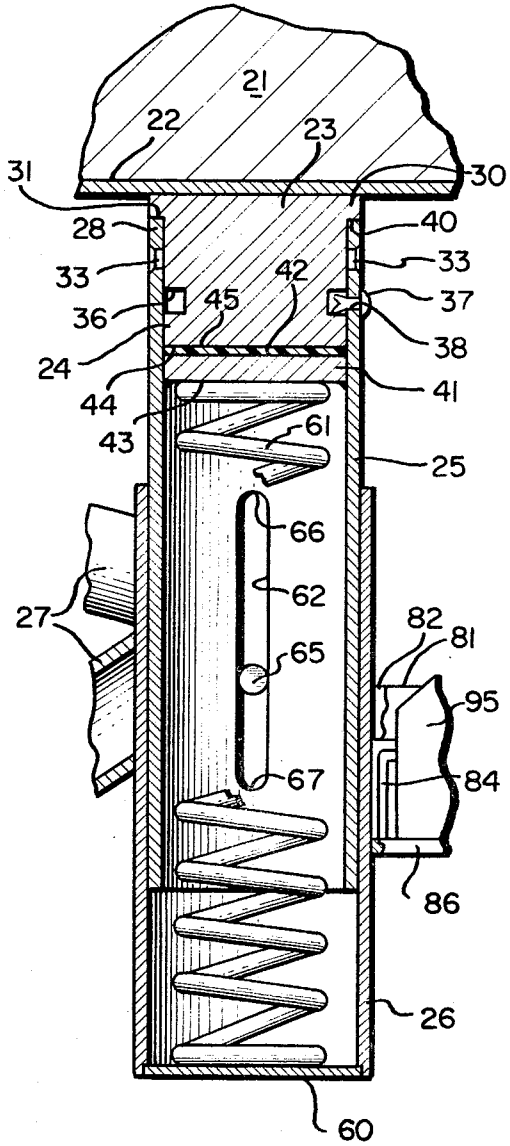
FIG. 7 is a sectional view, similar to FIG. 4 only showing the seat assembly in an elevated position compared to FIG. 4.

Referring now to FIG. 7, there is illustrated structure for connecting trunnion member 23 to intermediate member 25 to enable the two members to move vertically together while permitting trunnion member 23 to rotate relative to intermediate member 25. More particularly, trunnion member lower portion 24 has a peripheral groove 36. A fastener, such as a drive rivet 37 extends through an opening 38 in upper portion 28 of intermediate member 25 and into groove 36 on trunnion member 23 which receives and holds the tail of the drive rivet.

The engagement between fastener 37 and peripheral groove 36 in trunnion member 23 permits trunnion member 23 to rotate about its vertical axis, in relation to intermediate member 25, while connecting trunnion member 23 and intermediate member 25 together for vertical movement.

Drive rivet 37 cannot be removed from a securing disposition without destroying the drive rivet. This effectively prevents removal from the assembly of trunnion member 23 with seat 21 attached thereto and prevents pilferage of the seat. At such time as it may become necessary to remove trunnion member 23 for maintenance and repair on seat 21 attached thereto, this can be done by drilling out drive rivet 37. A set screw may be employed in lieu of drive rivet 37 to facilitate maintenance and repair work.

Now to be described is a mechanism for vertically adjusting seat 21. This mechanism is in the form of structure for vertically adjusting intermediate member 25 relative to base member 26. As previously described, when intermediate member 25 undergoes vertical adjustment, it carries with it trunnion member 23 and seat 21.

Referring to FIGS. 4, 5 and 7, located at the lower end of base member 26 is a plate 60. Supported atop plate 60 is the lower end of a coil spring 61 having an upper end bearing against the lower surface 43 of plate 41 which is fixed within intermediate member 25. Formed in the wall of intermediate member 25, below plate 41, is a vertically disposed slot 62 having an upper end 66 and a lower end 67. Welded to the outside of base member 26 is an internally threaded nut 64 through which extends a bolt 63 terminating at an end portion 65 which extends into slot 62 on intermediate member 25 and acts as a guide pin in the slot. The engagement of bolt and portion 65 in slot 62 also prevents intermediate member 25 from rotating relative to base member 26.

Coil spring 61 normally urges intermediate member 25 upwardly relative to base member 26. The lower limit of vertical travel by intermediate member 25 is determined by the engagement of bolt end portion 65 with the upper end 66 of slot 62. The upper limit of vertical travel by intermediate member 25 is determined by the engagement of bolt end portion 65 with the lower end 67 of slot 62.

As intermediate member 25 moves vertically, it carries with it trunnion member 23 and seat 21. The weight of a seat occupant is normally enough to overcome the upward urging of coil spring 61 and to maintain intermediate member 25 in a vertically depressed position (FIG. 4). To elevate intermediate member 25 and seat 21, the occupant need merely rise partially from the seat and support some of his weight on his feet on the floor 19 of the vehicle (FIG. 1). This allows coil spring 61 to urge intermediate member upwardly. Thus, the seat occupant can effect an adjustment of seat 21 to a desired vertical position merely by applying to or removing from seat 21 some of his weight.

Structure is provided for locking intermediate member 25 (and seat 21 with it) in any one of a plurality of vertically adjusted positions relative to base member 26, and this structure will now be described.

Figure 6:
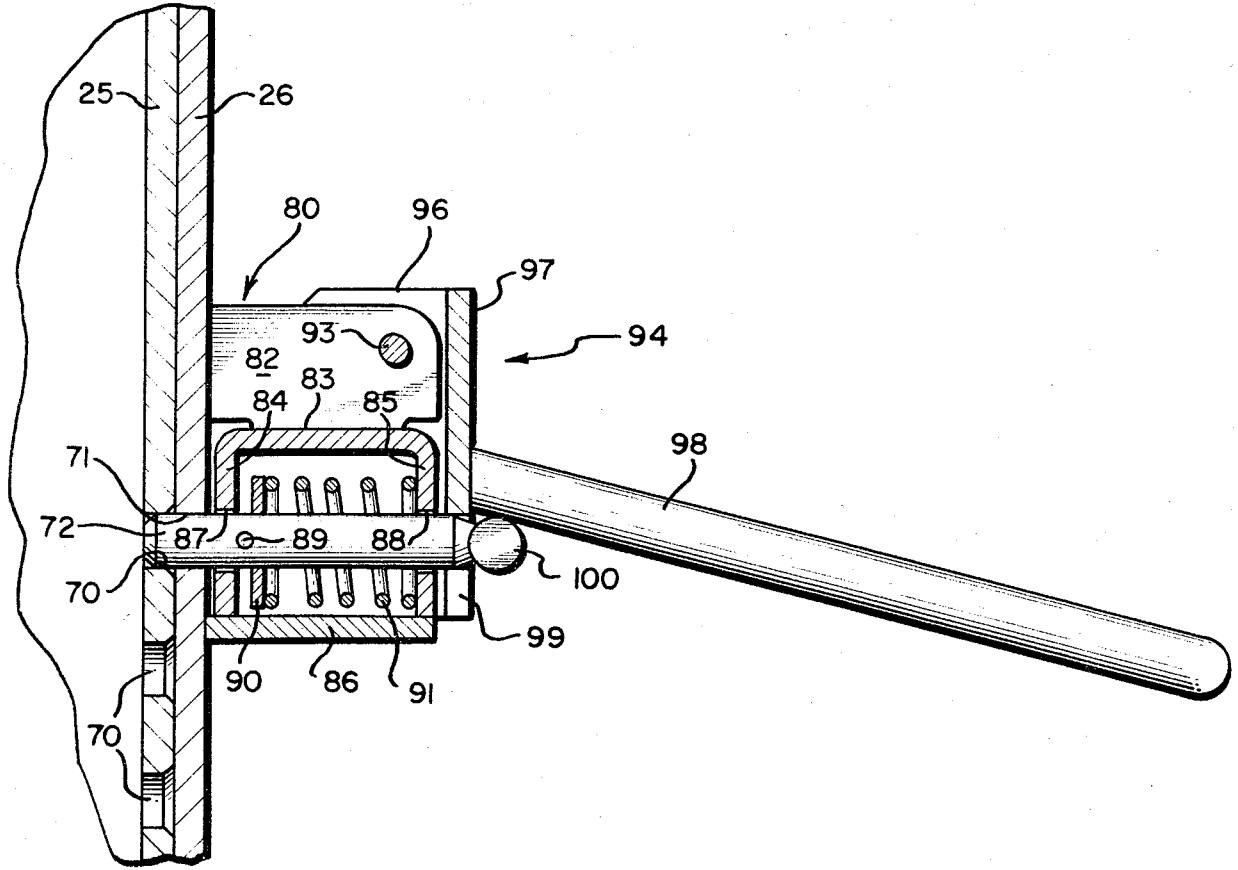
FIG. 6 is an enlarged, fragmentary, sectional view taken along line 6—6 in FIG. 3.

Referring initially to FIGS. 4–6, intermediate member 25 has a plurality of vertically aligned, vertically spaced holes 70, 70. Base member 26 has a hole 71 which is radially aligned with the series of vertically spaced holes 70, 70 in intermediate member 25. As indicated above, intermediate member 25 may be vertically raised by the action of coil spring 61, or may be vertically depressed or lowered by a force or weight on seat 21, to bring one of the holes 70 on intermediate member 25 in vertical alignment with the hole 71 on base member 26. When hole 71 is aligned with one of the holes 70, intermediate member 25 may be locked in the vertical position corresponding to the particular hole 70 which is then in alignment, employing a lock pin 72 which is extendible radially inwardly through openings 70, 71. Pin 72 is mounted for axial movement in a radial direction by structure connected to base member 26, and pin 72 is normally urged radially inwardly by that structure which will now be described with references to FIGS. 1–3, 4 and 6.

Attached to base member 26, as by welding, is a bracket 80 comprising a pair of parallel, spaced-apart upper flanges 81, 82 connected together by a lower web 83 from which depend a pair of parallel, spaced-apart lower flanges 84, 85 disposed transversely to upper flanges 81, 82. Extending between the bottom of flanges 84, 85 is a reinforcing strap 86. Each of the lower parallel flanges 84, 85 has an opening, 87, 88 respectively, and extending through openings 87, 88 is pin 72. Openings 87, 88 are aligned with hole 71 in base member 26, both vertically and radially, and are radially aligned with the series of vertically spaced openings 70, 70 in intermediate member 25. Openings 87, 88 mount pin 72 for movement in a back and forth direction along its axis.

Figure 3:
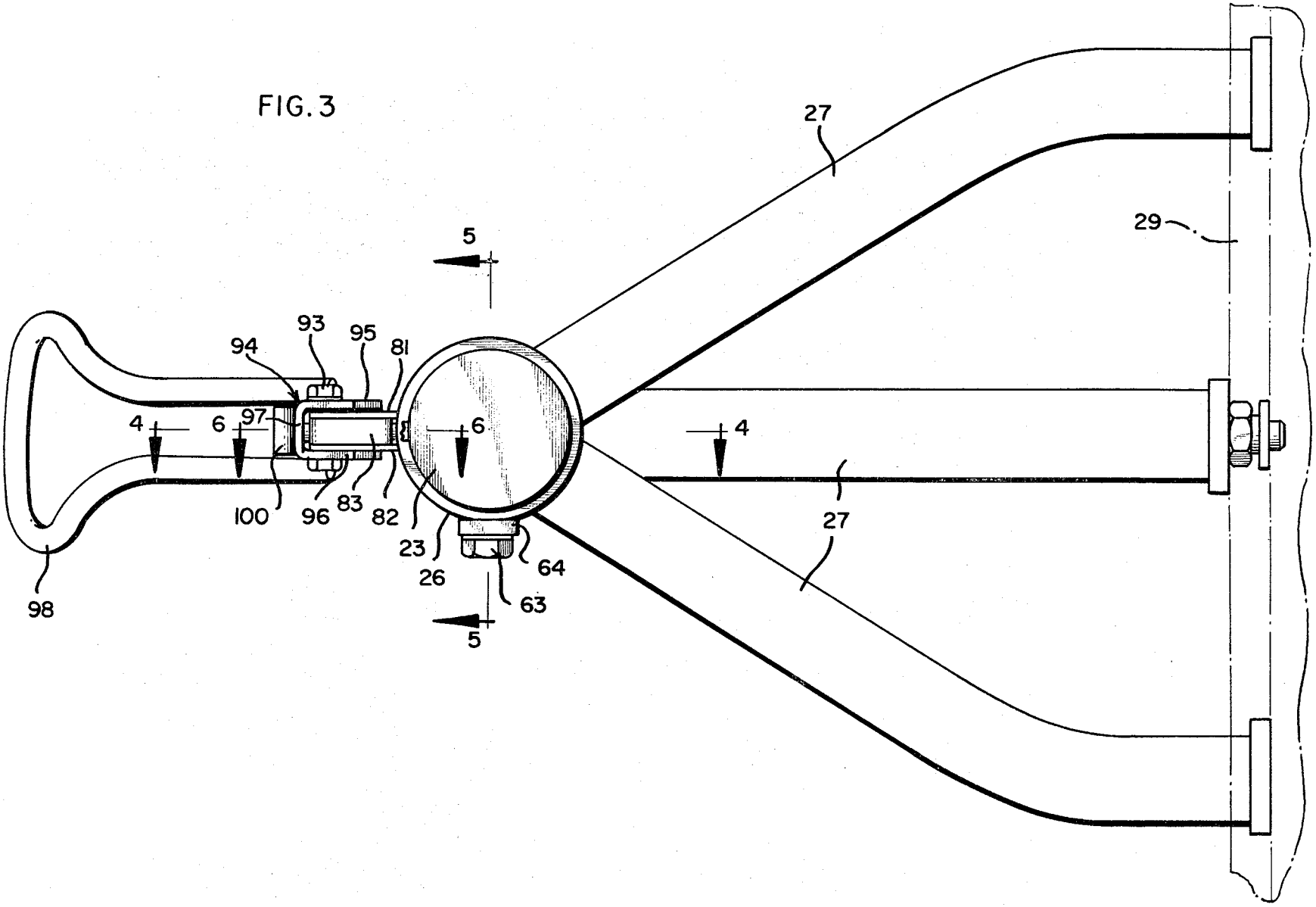
FIG. 3 is a sectional view taken along line 3—3 in FIG. 2.

Extennding transversely through lock pin 72 is a cross pin 89, and located adjacent cross pin 89 is a washer 90 located around the outside of lock pin 72. Also located around lock pin 72 is a coil spring 91 having an inner end engaging against washer 90 and an outer end engaging against the inner surface of lower flange 85 (FIGS. 3 and 6). Coil spring 91 urges lock pin 72 in a radially inward direction. Radially inward axial movement of lock pin 72 is limited by the engagement of cross pin 89 with the inner surface of lower flange 84. When radially inward movement of lock pin 72 is so limited, the lock pin is in the locking position illustrated in FIG. 6, extending through opening 71 in base member 26 and one of the openings 70 in intermediate member 25.

Pin 72 is retracted from the locking position shown in FIG. 6 to a retracted position in which pin 72 is completely withdrawn from an opening 70 in intermediate member 25, with structure now to be described.

Extending between parallel upper flanges 81, 82 on bracket 80 is a pivot 93, and pivotally mounted on pin 93 is a handle bracket 94 comprising a pair of spaced-apart, vertically disposed flanges 95, 96 connected by a web 97. Pivot pin 93 extends through flanges 95, 96. Attached to flanges 95, 96 is a bight-shaped handle 98. Extending upwardly from the bottom of web 97 is a notch 99 (FIG. 6), and extending outwardly through notch 99 is the radially outermost end of lock pin 72 which terminates at a cross arm 100.

The retraction of pin 72 from the locking position shown in FIG. 6 is effected in the following manner. When handle 98 is raised, handle bracket 94 is pivoted upwardly about the axis of pivot pin 93, in a counterclockwise sense as viewed in FIG. 6. As handle bracket 94 pivots thusly, the outer surface of web 97, around notch 99, engages against cross arm 100 exerting a radially outward pull on pin 72. Notch 99 accommodates movement of pin 72 in a strictly axial direction simultaneous with pivotal movement of web 97 (along with the rest of handle bracket 94). Because of the engagement between the outer surface of web 97 and cross arm 100, upward pivotal movement of handle bracket 94 is limited by the extent to which lock pin 72 undergoes radially outward movement which in turn is limited by the compression of coil spring 90.

To return pivot pin 72 from a retracted to an engaged position, handle 98 is released, and the action of coil spring 91 urges pivot pin 72 in a radially inward direction. When this occurs, cross arm 100 engages against the outer surface of handle bracket web 97 urging the handle bracket to pivot downwardly about the axis of pivot pin 93 in a clockwise sense as viewed in FIG. 6. Downward pivotal movement of handle bracket 94 is limited by the engagement of the top of notch 99 with pivot pin 72 (see FIG. 6).

The foregoing detailed description has been given for clearness of understanding only, and no unnecessary limitations should be understood therefrom, as modifications will be obvious to those skilled in the art.

I claim:

1. A seat assembly comprising:

a base member;

a vertically disposed, tubular intermediate member;

means mounting said intermediate member for vertical movement relative to said base member;

said tubular intermediate member having an upper portion terminating at a top edge defining an open upper end;

said upper portion of the tubular intermediate member having a cylindrical cross-section;

a vertically disposed trunnion member having a cylindrical cross-section;

said trunnion member having a lower portion received within said upper portion of the tubular intermediate member and an upper peripheral lip portion radially overlapping said top edge of the tubular intermediate member;

means on said trunnion member and on the upper portion of said tubular intermediate member mounting the trunnion member for rotation about a vertical axis;

said upper peripheral lip portion of the trunnion member having a lower surface engaging against said top edge on the upper portion of the tubular intermediate member without a friction-resistant surface therebetween;

a planar element fixed within said tubular intermediate member below its open upper end, said planar element having a flat upper surface and a lower surface;

said lower portion of the trunnion member having a flat bottom surface located adjacent said planar element;

a friction-resistant, wear-resistant member sandwiched between said flat bottom surface on the lower portion of the trunnion member and said flat upper surface on the planar element;

said planar element comprising means for supporting said trunnion member;

and means for supporting a seat atop said trunnion member.

2. A seat assembly as recited in claim 1 wherein:

said mounting means for the trunnion member comprises means mounting the trunnion member for rotation relative to the tubular intermediate member;

and said friction-resistant member and said planar element comprise means for preventing wear between said top edge on the upper portion of the intermediate member and the lower surface on said upper peripheral lip portion of the trunnion member.

3. A seat as recited in claim 2 and comprising:

a hole extending radially into the lower portion of said trunnion member;

a plurality of angularly spaced holes in the upper portion of said tubular intermediate member;

each of said plurality of angularly spaced holes being located at the same vertical level as said radially extending hole for axial alignment therewith upon rotation of the trunnion member to a predetermined position of rotation;

and pin means for extending through said axially aligned holes to lock said trunnion member in said predetermined position of rotation.

4. A seat as recited in claim 3 wherein:

said wear-preventing means comprises means for maintaining said radially extending hole at the same vertical level as said angularly spaced holes.

5. A seat assembly as recited in claim 1 wherein said vertical adjusting means comprises:

a coil spring having upper and lower ends;

means on said base member for supporting said lower end of the coil spring;

and means at the upper end of said coil spring for bearing against the lower surface of said planar element in the intermediate tubular member.

6. A seat assembly as recited in claim 5 wherein:

said base member is a vertically disposed tubular member;

and said tubular intermediate member is vertically aligned with said base member.

* * * * *

UNITED STATES PATENT AND TRADEMARK OFFICE

CERTIFICATE OF CORRECTION

PATENT NO. : 4,408,743

DATED : October 11, 1983

INVENTOR(S) : Robert W. DeWitt and Lester H. Feddeler

It is certified that error appears in the above-identified patent and that said Letters Patent are hereby corrected as shown below:

Col. 2, line 32, "the first" should be --the flat--;

Col. 6, line 56, "Extennding" should be --Extending--;

Col. 7, line 8, "pivot 93" should be --pivot pin 93--.

Signed and Sealed this

*Thirteenth* Day of *December 1983*

[SEAL]

*Attest:*

GERALD J. MOSSINGHOFF

*Attesting Officer*

*Commissioner of Patents and Trademarks*